US011578713B2

(12) United States Patent
Hoffmann et al.

(10) Patent No.: US 11,578,713 B2
(45) Date of Patent: Feb. 14, 2023

(54) SOUND ATTENUATION ARRANGEMENT FOR AN INVERTER COVER OF AN ELECTRIC COMPRESSOR

(71) Applicant: Hanon Systems, Daejeon (KR)

(72) Inventors: Michael Hoffmann, Cologne (DE); Philipp Benjack, Kerpen (DE)

(73) Assignee: HANON SYSTEMS, Daejeon (KR)

( * ) Notice: Subject to any disclaimer, the term of this patent is extended or adjusted under 35 U.S.C. 154(b) by 339 days.

(21) Appl. No.: 17/008,723

(22) Filed: Sep. 1, 2020

(65) Prior Publication Data

US 2021/0071655 A1 Mar. 11, 2021

(30) Foreign Application Priority Data

Sep. 9, 2019 (DE) ..... 102019124065.4

(51) Int. Cl.

| | |
|---|---|
| ***F04B 39/00*** | (2006.01) |
| ***F04B 39/12*** | (2006.01) |
| ***G10K 11/16*** | (2006.01) |

(52) U.S. Cl.

CPC ..... *F04B 39/0033* (2013.01); *F04B 39/121* (2013.01); *G10K 11/16* (2013.01)

(58) Field of Classification Search

CPC . F16F 15/06; F16F 15/08; F16F 15/04; F04B 39/0033; F04B 39/121; F04B 39/0044; F04B 39/0027; G10K 11/16

See application file for complete search history.

(56) References Cited

U.S. PATENT DOCUMENTS

| | | | |
|---|---|---|---|
| 10,172,247 | B2 | 1/2019 | Lenz et al. |
| 2016/0273605 | A1 | 9/2016 | Endo et al. |

FOREIGN PATENT DOCUMENTS

| | | | |
|---|---|---|---|
| CN | 101191476 | A | 6/2008 |
| CN | 208813318 | U | 5/2019 |
| DE | 102015112675 | A1 | 2/2016 |
| GB | 2088027 | A | 6/1982 |
| JP | S4716839 | Y1 | 6/1972 |
| JP | H08316662 | A * | 11/1996 |
| JP | 2012117444 | A | 6/2012 |
| JP | 2012117445 | A | 6/2012 |
| JP | 2014120677 | A | 6/2014 |

OTHER PUBLICATIONS

English translation of JP 2014-120677, accessed Sep. 30, 22 in USPTO Search tool (Year: 2014).*

* cited by examiner

*Primary Examiner* — Jeremy A Luks
(74) *Attorney, Agent, or Firm* — Shumaker, Loop & Kendrick, LLP; James D. Miller

(57) ABSTRACT

A sound attenuation arrangement for an inverter cover of an electric compressor, which is characterised in that in addition to fasteners for the inverter cover on the compressor housing of the electric compressor, a sound attenuation means for reducing noise emission via the inverter cover is provided, where the sound attenuation means is made up of a screw with a screw head and a screw shaft, and in that on the screw head a damping element is arranged, where the screw is in contact via the screw shaft with the compressor body, and via the damping element arranged on the screw head with the inverter cover, in a manner that absorbs vibrations.

15 Claims, 4 Drawing Sheets

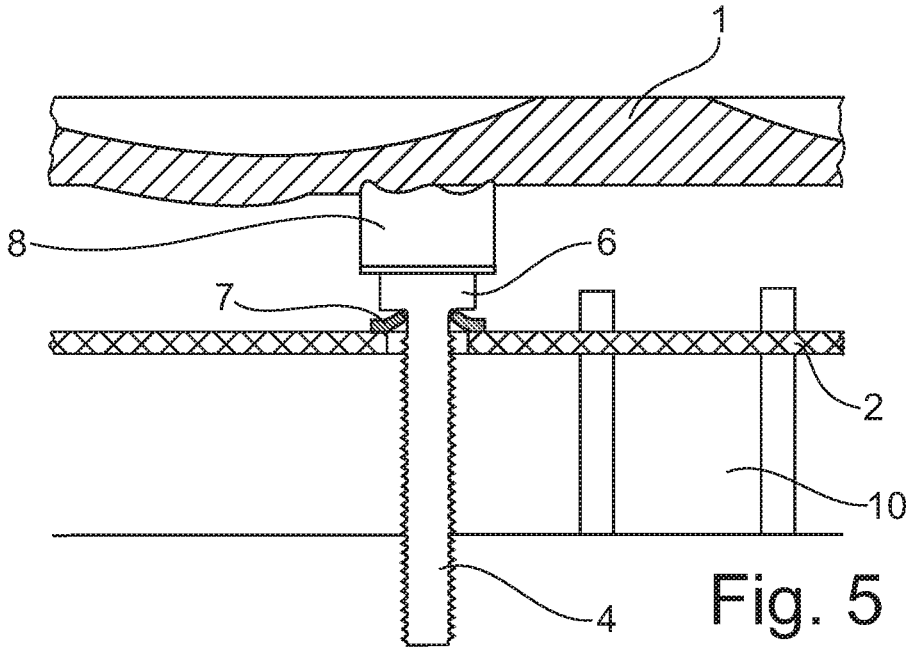
Fig. 5
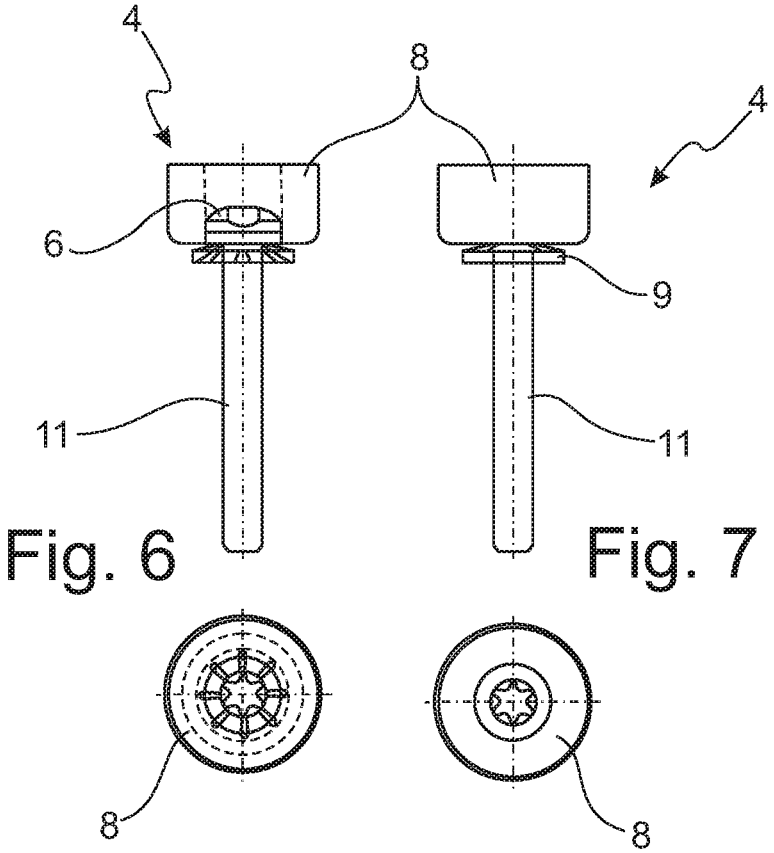
Fig. 6
Fig. 7

SOUND ATTENUATION ARRANGEMENT FOR AN INVERTER COVER OF AN ELECTRIC COMPRESSOR

CROSS-REFERENCE TO RELATED PATENT APPLICATION

The present disclosure claims the benefit of German Patent Application No. DE 2019124065.4 filed Sep. 9, 2019, the entire contents of which are hereby incorporated herein by reference.

FIELD

The invention relates in general to the sound attenuating design and installation of housing parts or covers on noise-emitting components. Particularly in the case of covers which are predominantly of flat and planar design and which as a result of fixings at the outer edges and less stiffened flat areas have surfaces which tend to vibrate with an associated emission of noise into the environment, noise protection measures are required.

BACKGROUND

Modern electric vehicles run almost noiselessly as far as the drivetrain is concerned, as a result of which other vehicle components, which also generate vibrations and noises, are now increasingly perceived to be a disturbance.

The transmission of disturbing noises into the vehicle interior leads to losses of comfort for driver and passengers. In addition, the transmission of disturbing noises into the surroundings results in noise pollution for the environment, which should be kept low in order to increase the acceptance of the vehicles and possibly also in order to comply with legal requirements.

In this context, the electric compressor, or to be precise the refrigerant compressor of the vehicle air conditioning system, also comes into focus as a noise source with regard to measures to reduce noise emissions.

The inverter cover of an electric compressor spans the inverter with the circuit board and is therefore part of the compressor housing. This cover is of planar and largely flat design, and covers the circuit board of the compressor. Due to the need to minimise the weight and installed size of the components, the possibilities for low-noise-emission design of the housing are sometimes limited.

Particularly in the case of air conditioning systems of more modern design, noises are increasingly perceived which were in the background in the case of conventional combustion-engine-powered vehicles and their accepted noise emissions. In the past, these sounds were masked and obscured and previously were not or were hardly perceived by the driver and the surroundings. One noise-emitting component of an electric vehicle is the electrically driven compressor of the air conditioning system.

SUMMARY OF THE INVENTION

The task of the invention is to make available a sound attenuation arrangement for an inverter cover of an electric compressor, which reduces internal and external sound radiation and therefore should increase the comfort and acceptance of the vehicle with an electric compressor for the air conditioning system.

The task of the invention is solved by means of a sound attenuation arrangement for an inverter cover with the features shown and described herein.

The task of the invention is solved in particular by a sound attenuation arrangement for an inverter cover of an electric compressor, which in addition to fasteners for the inverter cover on the compressor housing of the electric compressor also contains sound attenuation means to reduce noise emission via the inverter cover. The sound attenuation means is made up of a screw with a screw head and a screw shaft and contains a damping element on the screw head. The screw is joined via the screw shaft to the compressor housing, and via the damping element arranged on the screw head to the inverter cover, in a manner that transmits and absorbs vibrations.

According to the concept, via the screw, which is also referred to as a damping screw, one or more contacts are made with a sound attenuating element between the inverter cover and the internal wall, the compressor or the compressor housing. By means of the screw and the damping element, these additional contacts exert a force and hence a dampening effect on the inverter cover, which leads to a reduction in vibrations and hence to minimised radiation of sound waves into the vehicle interior and into the surroundings.

In an embodiment, the sound attenuation means is arranged in the central area of the inverter cover.

In another embodiment, several sound attenuation means are arranged by means of sound-absorbing connections between the compressor housing and the inverter cover in such a way that a vibration of the inverter cover and hence associated noise emissions are largely prevented.

The sound attenuation means, which is designed as a screw, is particularly preferably additionally designed to fix the circuit board to the circuit board frame and/or to the compressor housing. This ensures that a screw which may already be provided on the compressor for fixing the circuit board can be made suitable for an additional function of sound absorption by providing a damping element. Thus an additional advantage is created as a result of reducing the noise emissions in combination with the required fixing of the circuit board in the compressor.

An advantageous design of the invention consists in the screw having an integrated washer or a circuit board fixing element, with which the circuit board is indirectly fixed in place via the screw.

It is furthermore advantageous if the damping element of the damping means is made as an injection moulded part of silicone or of rubber.

Alternatively, the damping element of the damping means is made as a spring or gel cushion, by means of which vibrations can likewise be effectively absorbed.

It is particularly advantageous if the damping element is designed to push or clip onto the screw head of the screw. This means the damping element can be pushed or clipped onto conventional and already present screws for fixing the circuit board inside the inverter of the electric compressor, for example as a retrofit. In comparison with conventionally already used electric compressors, this measure then results in a reduction in the noise emissions of the electric compressor.

The damping element is advantageously vulcanised or glued onto the screw head of the screw, with the result that alternatively or cumulatively to the form-fitting connection a force-locked or material-bonded connection of the damping element to the screw head is ensured over the lifetime of the electric compressor.

In another embodiment, the screw is designed to be installable together with the damping element, which can also be achieved if the damping element is combined with the screw head not in a material-bonded manner but for example only in a form-fitting manner.

For the screw head drive, the screw head is advantageously designed as a slot, hex socket, hexalobular internal, triple square, Robertson, or cross-slot head.

It is particularly advantageous if the screw shaft of the screw is designed to be sufficiently long that via the screw-in depth into the corresponding receptacle in the compressor housing or in the circuit board frame, the damping strength of the damping element of the damping means is designed adjustably. As a result of screwing in the screw, the force and accordingly the damping decreases, since a lower force is exerted at the end of the damping element on the inverter cover. In the other case of reduced screw-in depth, the force and accordingly the damping increases in accordance with the elastic properties of the damping element.

The screw shaft of the screw is advantageously designed with an M3 or also M4 external thread corresponding to the receptacle in the compressor housing or in the circuit board frame.

According to the invention, the damping element is designed to be frustoconical in shape with an angle of inclination $\alpha$ (alpha) of 92° to 178° or with an angle of inclination $\beta$ (beta) of 2° to 89° relative to the center line. Thus the truncated cone of the damping element sits with the base up or down on the screw.

At the same time, the truncated circular cone of the damping element advantageously has a height of 2 mm to 18 mm.

The advantages of the invention consist in the fact that a sound attenuation arrangement can be made available efficiently with equipment of low complexity, which effectively and with a minimum of complexity reduces the noise emissions of the component via the inverter cover. The sound attenuation takes place via a sound-absorbing material as a damping element, which can be produced at very low cost and is of constructively simple design.

According to further development of the invention, the sound attenuation means can be equipped with an additional function of fixing the circuit board, as a result of which in a particularly advantageous way two technical functions and tasks can be realised or solved with one technical element.

It is furthermore advantageous that within the sound attenuation arrangement, the damping element can also be retrofitted to electric compressors with corresponding inverter covers, by using already existing screws inside the housing and subsequently adding corresponding damping elements to their screw heads.

The costs of the additional retrofitting of the components for sound attenuation are low compared to complex design measures to stiffen housing parts and covers or to create additional attachment points for these parts.

DESCRIPTION OF THE DRAWINGS

Further details, features and advantages of designs of the invention result from the following description of example embodiments with reference to the associated drawings. They show:

FIG. 5: Sound attenuation means with fixed circuit board,

FIG. 6: Sound attenuation means with recessed damping element,

FIG. 7: Side view of sound attenuation means, and

DETAILED DESCRIPTION

Figure 1:
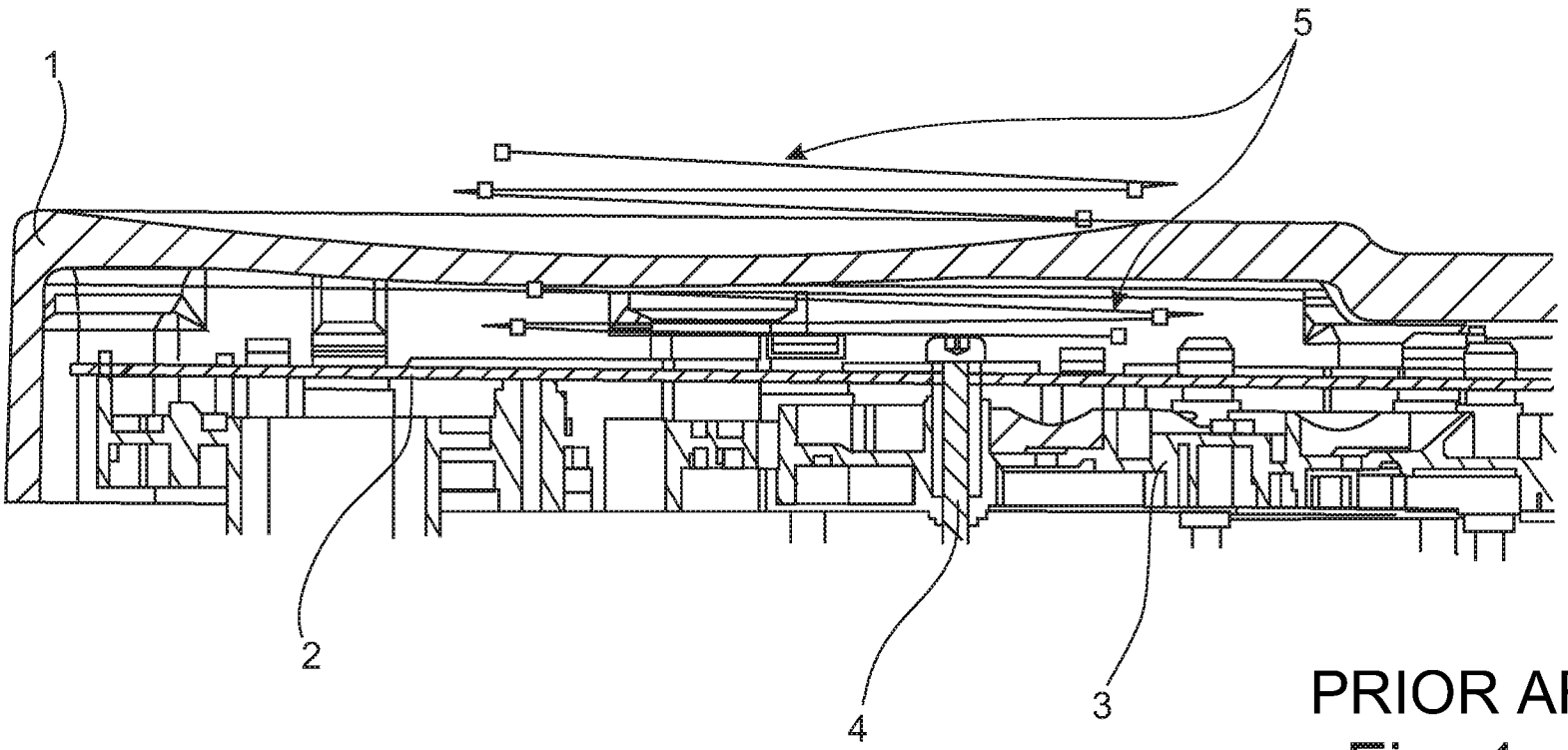
PRIOR ART Fig. 1
FIG. 1: Inverter cover according to the prior art.

FIG. 1 shows an inverter cover 1 of an electric compressor, which covers the region of the electric compressor which accommodates the inverter with the circuit board for the electronics of the component. In this design according to the prior art, sound waves 5 are transmitted from the inside of the component via the space between the inverter cover 1 and the circuit board 2 to the inverter cover 1. This causes the inverter cover 1 to vibrate, which leads to sound radiation to the outside. The circuit board 2 is fixed in a circuit board frame 3 by a screw 4. The circuit board frame 3 in turn is fastened to the compressor or, to be precise, to the compressor housing.

Figure 2:
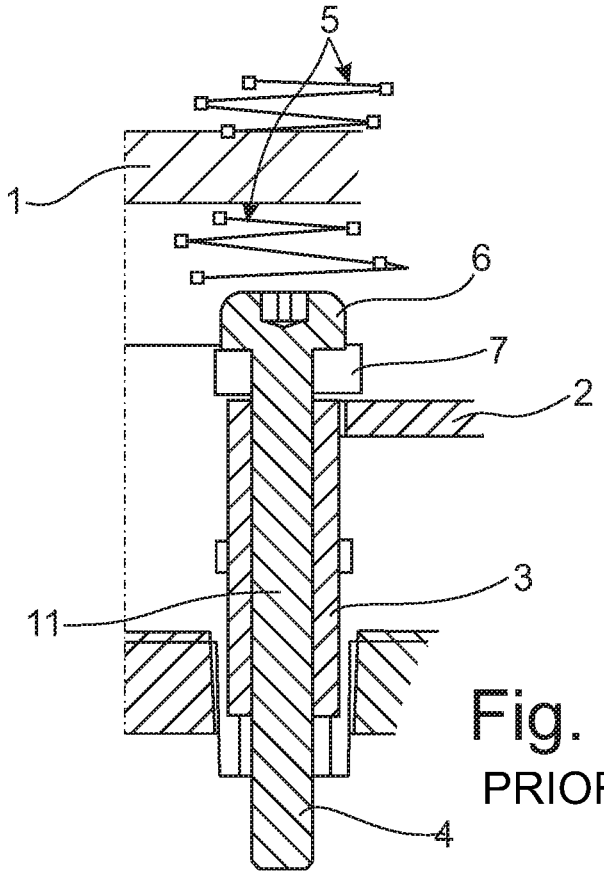
Fig. 2 PRIOR ART
FIG. 2: Detailed view of a non-damped inverter cover.

FIG. 2 shows a detail from FIG. 1 enlarged. It shows the screw 4, which is screwed into the circuit board frame 3 via a thread, and which fixes the circuit board in place. The screw 4 has a screw head 6 and a screw shaft 11. As the screw 4 is screwed into the circuit board frame 3, the lower edge of the screw head 6 acts on a circuit board fixing element 7, which presses the circuit board 2 against a support and therefore mechanically fixes it in place. As a result of its mechanical movements to compress the refrigerant, the electric compressor generates vibrations, which are transferred via the circuit board frame 3 and the circuit board 2. These vibrations or, to be precise, the sound waves 5 also excite vibrations in the inverter cover 1, as a result of which sound waves 5 are then emitted outwards into the surroundings.

Figure 3:
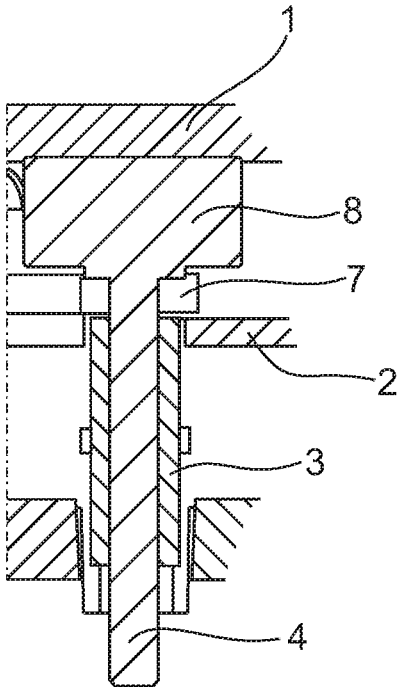
FIG. 3: Sound attenuation means.

Finally, FIG. 3 depicts a design of the invention whereas the sound attenuation means the screw 4 is retrofitted with a damping element 8 for the function of sound absorption, which is attached to the screw head which it covers. The damping element 8 is made of an elastic material such as silicone or rubber for example, and mechanically creates the connection between the screw 4 and the inverter cover 1. As a result, vibrations of the circuit board frame 3 and of the component of the electric compressor and of the circuit board 2 joined to it via the circuit board fixing element 7 and the threaded fastening of the screw 4 in the circuit board frame 3 are transferred to the damping element 8, which absorbs the vibrations in the elastic material by linking the damping element 8 to the inverter cover 1. The inverter cover 1 is therefore able to carry out vibrations only to a reduced extent and as a result emits fewer sound waves into the surroundings.

Figure 4:
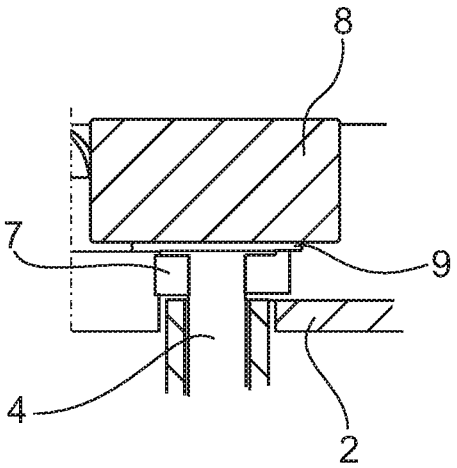
FIG. 4: Sound attenuation means with integrated washer.

In FIG. 4, the sound attenuation means is complemented by a washer 9 integrated into the screw in addition to the circuit board fixing element 7.

FIG. 5 shows the sound attenuation arrangement with the mechanical connection of the screw 4, the circuit board fixing element 7 and the screw head 6 via the damping element 8 towards the inverter cover 1. The compressor housing 10 forms the frame for supporting the circuit board 2 of the inverter.

FIG. 6 and FIG. 7 depict sound attenuation means, which are designed as a screw 4 with a screw head 6 and a screw shaft 11 as well as an integrated washer 9. In the depicted designs, the damping elements 8 are attached to the screw head 6, with the screw head in FIG. 6 being shown in cross-section. The damping elements 8 are of hollow cylindrical design. Via the hollow cylindrical recess, the screw head 6 is reachable with tools from above through the damping element 8 and therefore the screw 4 can be fitted together with the damping element 8. By screwing the screw 4 into the corresponding thread, depending on the screw-in depth the position of the damping element 8 within the sound attenuation arrangement can be exactly positioned in order to achieve maximum sound absorption in the damping element 8.

Figure 8:
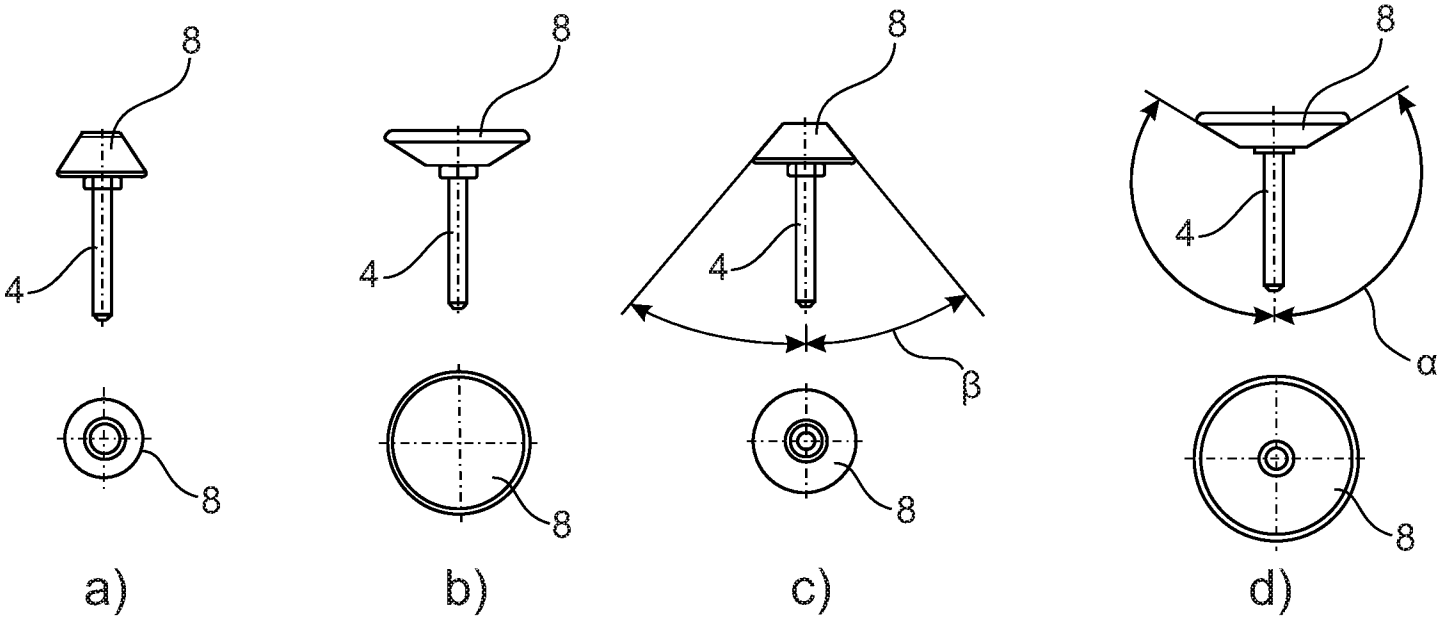
FIG. 8 *a*) to *d*): Sound attenuation means with variants of damping elements.

FIG. 8 *a*) to *d*) shows various sound attenuation means, which consist of a screw 4 and damping elements 8 correspondingly arranged on the screw head. The geometry of the depicted damping elements 8 is frustoconical, with the damping elements 8 having different heights and angles of inclinations of the edges. FIG. 8*a*) depicts a screw 4 with a damping element 8, which has a height of 3 mm to 18 mm. The damping element 8 according to FIG. 8*b*) has a height between 2 mm and 18 mm. FIG. 8*c*) depicts a damping element 8, where the slope of the truncated cone with the angle of inclination β is between 2° and 89°. In comparison with this, FIG. 8*d*) depicts a damping element 8 in which the damping element 8 has an angle of inclination α of at least 92° to 178°. The various ranges of the angle of inclination α and β result in correspondingly oppositely oriented truncated cones, where the distal limit of the sound attenuation means is in one case the tip of the truncated cone and in another case the base of the truncated cone. Via the design of the geometry of the damping element 8, the damping characteristics can be influenced as they can via the material of the damping element 8. Particularly preferably it is designed as an injection moulded part made of silicone, which is pushed onto the screw head of the screw 4 in a form-fitting manner. The thread diameter of the screw shaft 11 of the screw is optionally M3 or M4.

LIST OF REFERENCE NUMERALS

1 Inverter cover
2 Circuit board
3 Circuit board frame
4 Screw
5 Sound waves
6 Screw head
7 Circuit board fixing element
8 Damping element
9 Integrated washer
10 Compressor housing
11 Screw shaft

What is claimed is:

1. A sound attenuation arrangement for an inverter cover of an electric compressor, fasteners for the inverter cover on a housing of the electric compressor; and a sound attenuation means for reducing noise emission via the inverter cover, wherein the sound attenuation means further comprises:

a screw with a screw head and a screw shaft; and a damping element arranged on the screw head, wherein the screw is in contact via the screw shaft with a compressor body and via the damping element arranged on the screw head with the inverter cover in a manner that absorbs vibrations, wherein the damping element is attached to the screw head and the damping element includes a hollow cylindrical recess.

2. The sound attenuation arrangement according to claim 1, wherein the sound attenuation means is arranged in a central area of the inverter cover.

3. The sound attenuation arrangement according to claim 1, wherein a plurality of the sound attenuation means is provided for a sound-absorbing linking of the housing and the inverter cover.

4. The sound attenuation arrangement according to claim 1, wherein the screw fixes a circuit board to a circuit board frame and/or to the housing.

5. The sound attenuation arrangement according to claim 4, wherein the screw has an integrated washer or a circuit board fixing element.

6. The sound attenuation arrangement according to claim 1, wherein the damping element is an injection moulded part made of silicone or made of rubber.

7. The sound attenuation arrangement according to claim 1, wherein the damping element is a spring or a gel cushion.

8. The sound attenuation arrangement according to claim 1, wherein the damping element pushes or clips onto the screw head of the screw.

9. The sound attenuation arrangement according to claim 1, wherein the damping element is vulcanised or glued onto the screw head of the screw.

10. The sound attenuation arrangement according to claim 1, wherein the screw is installable together with the damping element.

11. The sound attenuation arrangement according to claim 1, wherein the screw head is a slot, a hex socket, a hexalobular internal, a triple square, a Robertson, or a cross-slot head.

12. The sound attenuation arrangement according to claim 4, wherein the screw shaft is sufficiently long that via a screw-in depth into a corresponding receptacle in the housing or in the circuit board frame, a damping strength of the damping element is adjustable.

13. The sound attenuation arrangement according to claim 1, wherein the screw shaft includes an M3 or M4 external thread.

14. The sound attenuation arrangement according to claim 1, wherein the damping element is frustoconical in shape with an angle of inclination α of 92° to 178° or β of 2° to 89° relative to a center line of the damping element.

15. The sound attenuation arrangement according to claim 14, wherein a truncated circular cone of the damping element has a height of 2 mm to 18 mm.

* * * * *